US008410864B2

(12) United States Patent
Charley et al.

(10) Patent No.: US 8,410,864 B2
(45) Date of Patent: Apr. 2, 2013

(54) INTEGRATED DIRECTIONAL COUPLER

(75) Inventors: Sylvain Charley, Mettray (FR); François Dupont, Tours (FR); Hilal Ezzeddine, Tours (FR)

(73) Assignee: STMicroelectronics (Tours) SAS, Tours (FR)

( * ) Notice: Subject to any disclaimer, the term of this patent is extended or adjusted under 35 U.S.C. 154(b) by 325 days.

(21) Appl. No.: 12/494,046

(22) Filed: Jun. 29, 2009

(65) Prior Publication Data

US 2010/0001810 A1 Jan. 7, 2010

(30) Foreign Application Priority Data

Jul. 1, 2008 (FR) ..... 08 54448

(51) Int. Cl.
*H01P 5/12* (2006.01)
*H01P 5/18* (2006.01)

(52) U.S. Cl. ..... 333/109; 333/116

(58) Field of Classification Search ..... 333/109, 333/110, 111, 112, 116, 117, 118
See application file for complete search history.

(56) References Cited

U.S. PATENT DOCUMENTS

| | | | | |
|---|---|---|---|---|
| 3,593,208 | A | 7/1971 | Smith | |
| 4,013,981 | A | 3/1977 | Shintani et al. | |
| 4,027,254 | A | 5/1977 | Gunton et al. | |
| 4,375,054 | A | 2/1983 | Pavio | |
| 4,754,241 | A | 6/1988 | Spinner | |
| 4,937,541 | A | 6/1990 | Podell et al. | |
| 5,006,821 | A | 4/1991 | Tam | |
| 5,159,298 | A | 10/1992 | Dydyk | |
| 5,243,305 | A | 9/1993 | D'Oro et al. | |
| 5,363,071 | A | 11/1994 | Schwent et al. | |
| 5,424,694 | A | 6/1995 | Maloratsky et al. | |
| 5,629,654 | A | 5/1997 | Frick | |
| 6,018,277 | A | 1/2000 | Vaisanen | |
| 6,150,898 | A | 11/2000 | Kushitani et al. | |
| 6,323,741 | B1 | 11/2001 | Kim | |
| 6,483,415 | B1 | 11/2002 | Tang | |
| 6,683,512 | B2 | 1/2004 | Nakamata et al. | |
| 6,825,738 | B2 | 11/2004 | Shumovich | |
| 7,026,887 | B2 * | 4/2006 | Watanabe et al. | 333/126 |
| 7,149,496 | B2 * | 12/2006 | Horiuchi et al. | 455/333 |
| 7,394,333 | B2 | 7/2008 | Ezzeddine et al. | |

(Continued)

FOREIGN PATENT DOCUMENTS

| | | | |
|---|---|---|---|
| JP | 56 062402 | A | 5/1981 |
| JP | 05 259717 | A | 10/1993 |

(Continued)

OTHER PUBLICATIONS

French Search Report from French Patent Application No. 02/15477 dated Jul. 4, 2005.

(Continued)

*Primary Examiner* — Dean O Takaoka
(74) *Attorney, Agent, or Firm* — Wolf, Greenfield & Sacks, P.C.

(57) ABSTRACT

A coupler including: a first conductive line intended to convey a signal to be transmitted between first and second terminals; a second conductive line, coupled to the first one and having one end intended to provide, on a third terminal, data relative to a signal reflected on the second terminal; and an inductive and/or capacitive impedance matching circuit, interposed between the other end of the second line and a fourth terminal of the coupler.

24 Claims, 4 Drawing Sheets

U.S. PATENT DOCUMENTS

| | | | | |
|---|---|---|---|---|
| 7,417,516 | B2 * | 8/2008 | Singh | 333/109 |
| 7,705,681 | B2 * | 4/2010 | Ilkov | 330/295 |
| 2004/0061571 | A1 | 4/2004 | Pozdeev | |
| 2005/0212617 | A1 | 9/2005 | Chen | |
| 2006/0119452 | A1 | 6/2006 | Kim et al. | |
| 2009/0128255 | A1 | 5/2009 | Dupont et al. | |

FOREIGN PATENT DOCUMENTS

| | | | |
|---|---|---|---|
| JP | 2000022411 | A | 1/2000 |
| JP | 2002 299922 | A | 10/2002 |

OTHER PUBLICATIONS

French Search Report from French Patent Application No. 07/59185 dated Jul. 11, 2008.

Ojha, S. et al., "Reduced Size RF Coupler Design for Specialized Load Requirements," *IEEE Proceedings of the 40th Midwest Symposium on Circuits and Systems*, Sacramento, CA, USA Aug. 3-6, 1997, New York, NY USA, US, Aug. 3, 1997, pp. 595-598.

Chen, J-L et al. "A High-Directivity Microstrip Directional Coupler With Feedback Compensation," 2002 IEEE MTT-S International Microwave Symposium Digest. (IMS 2002). Seattle, WA Jun. 2-7, 2002, IEEE MTT-S International Microwave Symposium, New York, NY: IEEE, US, vol. 1 of 3, Jun. 2, 2002, pp. 101-104.

French Search Report dated Feb. 12, 2009, from corresponding French Application No. 08/54448.

* cited by examiner

Prior Art

Prior Art

INTEGRATED DIRECTIONAL COUPLER

CROSS REFERENCE TO RELATED APPLICATIONS

This application claims the priority benefit of French patent application number 08/54448, filed on Jul. 1, 2008, entitled "INTEGRATED DIRECTIONAL COUPLER," which is hereby incorporated by reference to the maximum extent allowable by law.

BACKGROUND OF THE INVENTION

1. Field of the Invention

The present invention generally relates to the electronics industry and, more specifically, to radiofrequency transceiver systems. The present invention more specifically relates to a directional coupler and applications thereof.

2. Discussion of the Related Art

A coupler is generally used to sample part of the power present on a so-called main or primary transmission line, with respect to another so-called coupled or secondary line, located nearby.

Couplers can be classified in two categories according to whether they are formed of discrete passive components (couplers with lumped elements) or of conductive lines arranged close to one another to be coupled (distributed couplers). The present invention relates to the second category of couplers.

In many applications, it is needed to sample part of the power transmitted over a line, for example, to control the power of an amplifier in a transmit circuit, to control the linearity of a transmit amplifier according to the losses linked to the reflection of an antenna, to dynamically match an antenna, etc.

A coupler is defined, among others, by its directivity which represents the power difference (expressed in dB) between the two access ports of its coupled or secondary line. Theoretically, an ideal coupler has an infinite directivity, that is, no power is present on the port of its secondary line located opposite to the output port of its main line when a signal runs through this main line from the input port to this output port. In practice, a coupler is said to be directional when its directivity is sufficient (typically greater than +20 dB) for the powers recovered from the access ports of its secondary line to enable to make out the direction of the power flow in its main line. When the two ports of the secondary line of the coupler can be used to simultaneously have the power information, the coupler is said to be bidirectional. In this case, the respective input and output ports of the main line and of the secondary line may be inverted.

If all ports are perfectly matched (typically, at 50 ohms), no stray reflection occurs and the coupler operates ideally. Such a perfect matching can unfortunately not be obtained in practice. In particular, the output port (typically, to which an antenna is connected) may undergo impedance modifications even in real time under the effect of modifications in the environment of the antenna. Such modifications generate stray reflections, which results in return loss, to be taken into account in the transmission chain.

A lack of directivity of the coupler adversely affects the accuracy of the measurements of a mismatch of the main line output port. Now, this mismatch is an important criterion of the transmission. The return loss is assessed on one of the ports of the secondary line of the coupler. Its measurement is, for example, used to modify the parameters of an impedance matching network interposed between the main coupler line and the antenna.

The signal sampled from the secondary line is tainted with non-negligible errors and is no longer usable when the coupler directivity is lower than 20 dB. The output impedance of the coupler can then no longer be controlled, whereby the return loss cannot be corrected.

To overcome a possible mismatch of the port of the secondary line of the coupler from which the data are sampled, the ends of the secondary line are sometimes equipped with attenuators. Such attenuators have no effect on the actual directivity of the coupler.

SUMMARY OF THE INVENTION

It would be desirable to improve the directivity of a coupler to overcome all or part of the disadvantages of usual couplers.

It would also be desirable to avoid using attenuators on the secondary line.

To achieve all or part of these objects as well as others, at least one embodiment of the present invention provides a distributed directional coupler comprising a first conductive line intended to convey a signal to be transmitted between first and second terminals;

a second conductive line, coupled to the first one and having one end intended to provide, on a third terminal, data relative to a signal reflected on the second terminal; and an inductive and/or capacitive impedance matching circuit, interposed between the other end of the second line and a fourth terminal of the coupler.

According to an embodiment of the coupler, the components of the inductive and/or capacitive matching circuit are determined to compensate, on the third terminal, a signal originating from the first terminal.

According to an embodiment of the coupler, said matching circuit brings is an inductance ranging between 0 and 10 nH and a capacitance ranging between 0 and 20 pF.

At least one embodiment of the present invention also provides a circuit for transmitting or receiving radiofrequency signals, comprising:

at least one amplifier;

at least one coupler with an impedance-matching circuit; and at least one circuit for measuring data sampled from the third terminal.

The foregoing objects, features, and advantages of the present invention will be discussed in detail in the following non-limiting description of specific embodiments in connection with the accompanying drawings.

DETAILED DESCRIPTION

Figure 1:
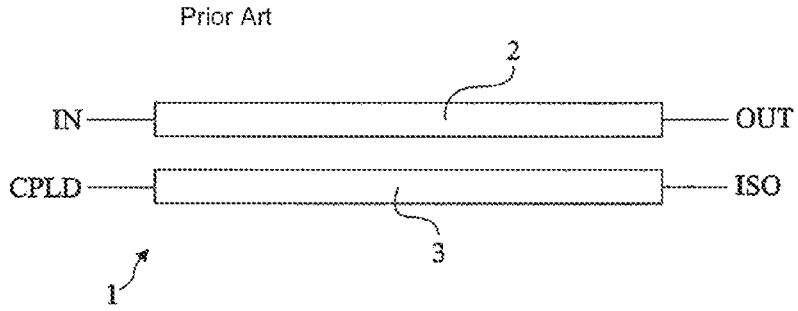
FIG. 1 shows an example of a conventional distributed coupler.

The same elements have been designated with the same reference numerals in the different drawings. Further, for clarity, only those elements which are useful to the understanding of the present invention have been shown and will be described. In particular, the different possible uses of the signal sampled from the secondary line of the coupler have not been detailed, the present invention being compatible with any typical use.

FIG. 1 is a simplified view of a distributed coupler. A main line 2 of coupler 1 is intended to be interposed on a transmission line and comprises two respective so-called input and output ports or terminals IN and OUT (or DIR). A secondary line 3, coupled to the first one, comprises two respective so-called coupled and isolated ports or terminals CPLD (on the side of terminal IN) and ISO (on the side of terminal OUT), and is intended to convey the information proportional to the power transmitted in line 2. The lengths of the lines depend on the desired operating frequency. Their width depends on the searched characteristic impedance.

The coupler of FIG. 1 is desired to be directional, that is, with signals present on ports CPLD and ISO exhibiting different levels. Such a coupler is however symmetrical, which makes it bidirectional, that is, in the same way as a signal applied on terminal IN is coupled on terminal CPLD, a signal applied on terminal OUT is coupled at the level of terminal ISO. Accordingly, a reflection from an antenna connected to terminal OUT appears on port ISO of the coupler. In a symmetrical directional coupler such as illustrated in FIG. 1, the terminals are defined by the coupler connections to the other elements.

The main parameters of a coupler are:

the insertion loss, which represents the transmission loss between the access ports (IN and OUT) of the main line (the insertion loss is defined with the other two ports of the coupler loaded with a 50-ohm impedance);

the coupling, which represents the transmission loss between input port IN and coupled port CPLD (the coupling is defined with the other two ports OUT and ISO loaded with a 50-ohm impedance);

the isolation, which represents the transmission loss between input port IN and isolated port ISO opposite to the coupled port (the isolation is defined with the other two ports OUT and CPLD loaded with a 50-ohm impedance); and the directivity which represents the transmission loss difference between isolated and coupled ports ISO and CPLD, from port IN.

Figure 2A:
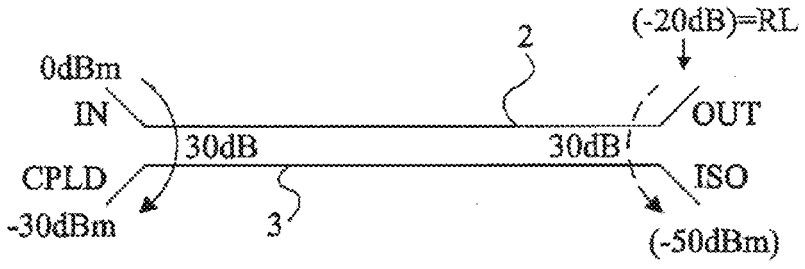
Fig 2A Prior Art
FIGS. 2A, 2B, and 2C are simplified representations of the coupler of FIG. 1 illustrating its operation for three directivity values.
Figure 2B:
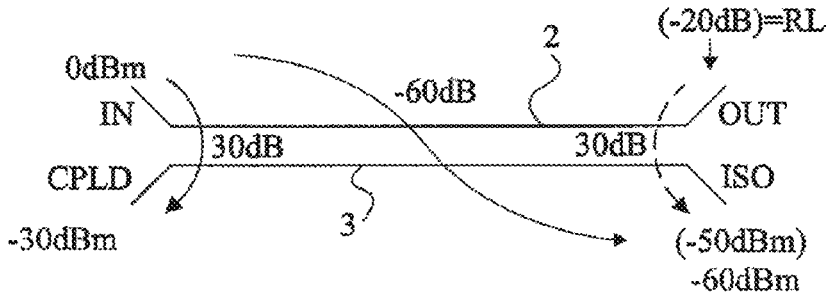
Fig 2B Prior Art
Figure 2C:
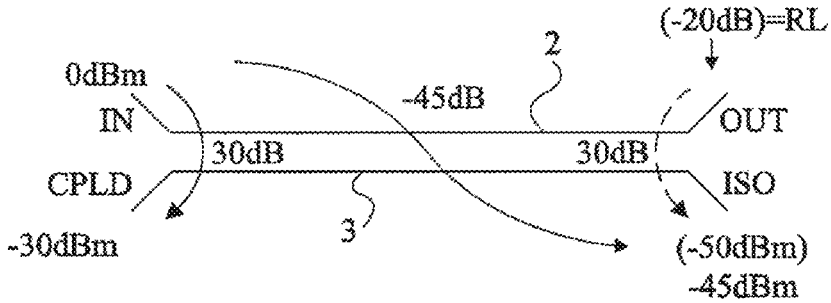

FIGS. 2A, 2B, and 2C illustrate the operation of the coupler of FIG. 1 in three situation examples.

In all these examples, the case of a −30-dB coupling is considered, which corresponds to sampling, from the secondary line, 1/1000 of the power transmitted over the main line. A non-zero return coefficient of the antenna is further assumed. This results in a return loss RL which reaches port OUT. The return loss is assumed to be 20 dB. The measurement of the return loss exploits the coupling between terminals OUT and ISO and is performed by calculating the difference between the signals present on ports CPLD and ISO. In the drawings, the return operating data are illustrated in brackets.

FIG. 2A illustrates a theoretical example of coupler operation where the directivity is infinite. Assuming input IN to be driven by a signal, for example, at 0 dBm, the data received on terminal CPLD exhibit a −30-dBm level due to the 30-dB coupling coefficient. With a 20-dB return loss, the antenna returns a −20-dBm signal on terminal OUT. Since the coupler is symmetrical, a signal on terminal OUT is coupled on terminal ISO with a −30-dB coupling (dotted lines between ports OUT and ISO). As a result, the reflected signal exhibits a −50-dBm level on terminal ISO. In such a case, it can be seen that a measurement of the signal on port ISO enables to measure the variations of the return loss linked to the antenna, and thus a mismatching of the antenna.

FIG. 2B illustrates another example according to which the coupler directivity is 30 dB, which, with a −30-dB coupling, provides a −60-dB isolation between terminals IN and ISO. Taking the example of a signal driving terminal IN with a 0-dBm level, terminal CPLD still exhibits a −30-dBm level. With an antenna having a −20-dB return loss, the signal returned at −20 dBm on terminal OUT is at a −50-dBm level again on terminal ISO. However, port ISO sees not only this −50-dBm signal, but also a −60-dBm signal linked to the directivity (isolation signal). The signal on port ISO is thus disturbed by the signal leakage due to the non-perfect directivity of the coupler. As will better appear from the description of FIG. 3, the possible error of the measurement on the isolated port will depend on the relative phase between the signal resulting from the return loss coupling and the isolation signal.

FIG. 2C illustrates a third example in which the coupler directivity is −15 dB only, which, with a 30-dB coupling, amounts to an isolation signal attenuated by −45 dB (on port ISO) with respect to that driving port IN. With the same data as in the previous examples, a parasitic signal linked to the lack of isolation of a −45-dBm level is obtained on port ISO. This parasitic signal has an amplitude greater than that of the −50-dBm signal useful for the measurement. The measured signal thus becomes impossible to use to detect a possible mismatching of the antenna.

Figure 3:
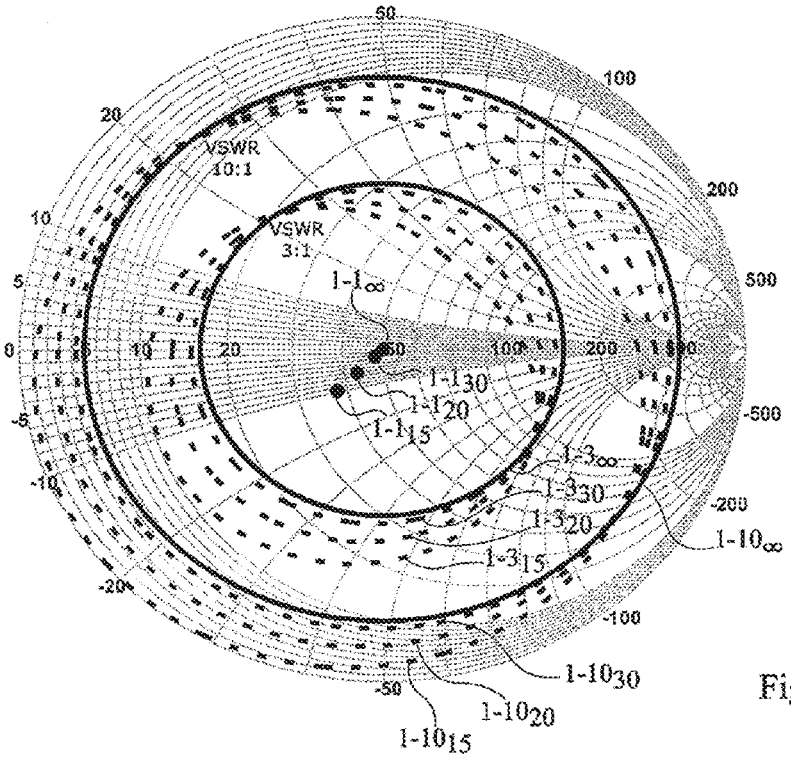
FIG. 3 shows a Smith chart illustrating the mismatch circles for the three examples of directivity of FIGS. 2A to 2C and four examples of voltage standing wave ratios.

FIG. 3 is a Smith chart illustrating the impact of the coupler directivity for different voltage standing wave ratios (VSWR). The coupler directivity conditions, independently from the voltage standing wave ratio, the position of the mismatch circle. FIG. 3 shows examples of mismatching circles for voltage standing wave ratios of 1, which amounts to a point (no reflection from the antenna), of 3 (−6-dB reflection), and of 10 (−1.7-dB reflection), for couplers having directivities which are infinite (point $1\text{-}1_{\infty}$, circles $1\text{-}3_{\infty}$ and $1\text{-}10_{\infty}$), of 20 dB (point $1\text{-}1_{20}$, circles $1\text{-}3_{20}$ and $1\text{-}10_{20}$), of 30 dB (point $1\text{-}1_{30}$, circles $1\text{-}3_{30}$ and $1\text{-}10_{30}$), and of 15 dB (point $1\text{-}1_{15}$, circles $1\text{-}3_{15}$ and $1\text{-}10_{15}$). It can be seen that when the directivity becomes too low, the measurement is tainted with error since, for certain phases, a measurement may suggest a mismatching (change of the voltage standing wave ratio) while the variation is due to the coupler directivity.

Figure 4:
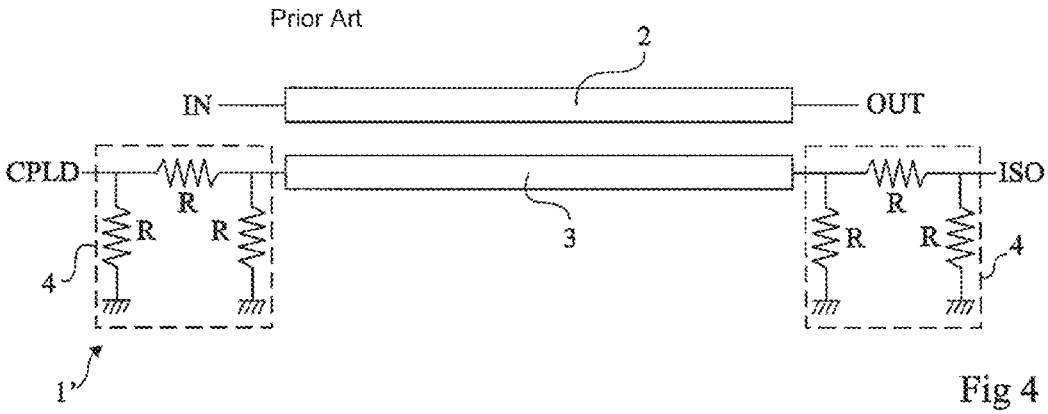
FIG. 4 shows another example of a conventional distributed coupler.

FIG. 4 shows a coupler 1' having its ports CPLD and ISO loaded with attenuators 4. In the example, attenuators formed of three pi-connected resistors R are assumed. A first resistor R is interposed in series at each end of the line while the other two resistors ground the two ends of the first resistor. The function of attenuators 4 is to overcome possible mismatches on ports CPLD and ISO to attenuate stray reflections. They are, however, ineffective on the coupler directivity. Further, the presence of attenuators on ports CPLD and ISO increases the coupling, and thus insertion losses.

Figure 5:
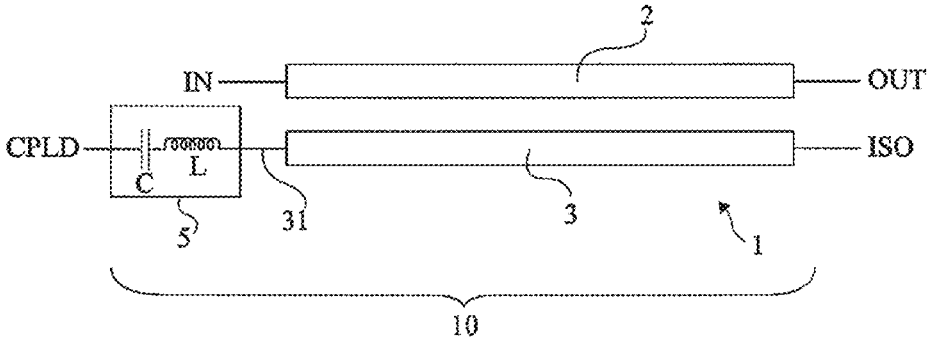
FIG. 5 shows an embodiment of a coupler.

FIG. 5 shows an embodiment of a coupler 10. This drawing should be compared with FIGS. 1 and 4. It shows main line 2 between ports IN and OUT and secondary line 3 between ports CPLD and ISO. However, an impedance matching element 5 is interposed between end 31 of secondary line 3 and port CPLD. Matching element 5 is of inductive and capacitive type (LC). In the simplified version illustrated in FIG. 5, it is formed of an inductive element L in series with a capacitor C between end 31 of line 3 and port CPLD. The function of element 5 is to modify the impedance on the coupled port to cancel the parasitic signal due to the intrinsic directivity of the coupler. The assembly of real coupler 1 and network 5 then operates as an ideal coupler 10 with an infinite directivity.

Matching element 5 has an impedance different from the normalized 50-ohm impedance and is different from an attenuator which only brings a real part to the impedance of the coupled port.

Matching element 5 is placed on the port opposite to that from which the information is sampled. Thus, to measure the return loss of the antenna, the measurement is performed on port ISO and element 5 is placed on port CPLD.

Since the directivity is linked to the intrinsic performance of the coupler and to its manufacturing, especially in terms of length, spacing, and operating frequency, matching network 5 is preferably determined, in a simulation, by determination of the impedance to be presented on the coupled port to cancel an intrinsic parasitic signal of the coupler obtained by simulation. The isolation signal (between port IN and port ISO), noted S2 and linked to the intrinsic directivity of the coupler, may be written as S2=A. $\cos(\omega t+\phi)$, where A designates the amplitude, $\omega$ designates the pulse, and $\phi$ designates the intrinsic phase shift introduced by the real coupler part 1 between ports CPLD and ISO. In an ideal coupler, signal S2 is zero.

The provided solution amounts to generating, with matching network 5, a return coefficient on port CPLD such that the signal, noted S3, between ports CPLD and ISO compensates the isolation signal of part 1. One needs to obtain S3=A. $\cos(\omega t+\phi+\pi)$. Indeed, the amplitude of the return coefficient needs to be equal to the amplitude of isolation signal S2 and its phase needs to be opposite to that of this isolation signal (corrected with intrinsic phase-shift $\phi$ between terminals CPLD and ISO).

Figure 6A:
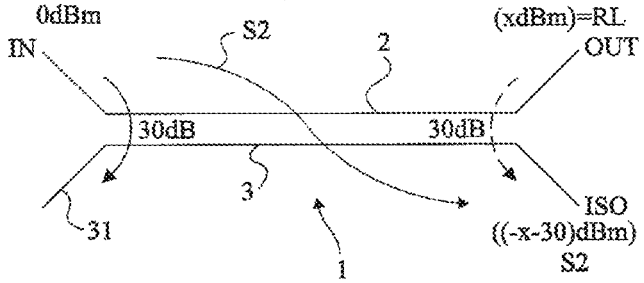
FIGS. 6A and 6B are simplified representations of the coupler of FIG. 5 illustrating its operation.
Figure 6B:
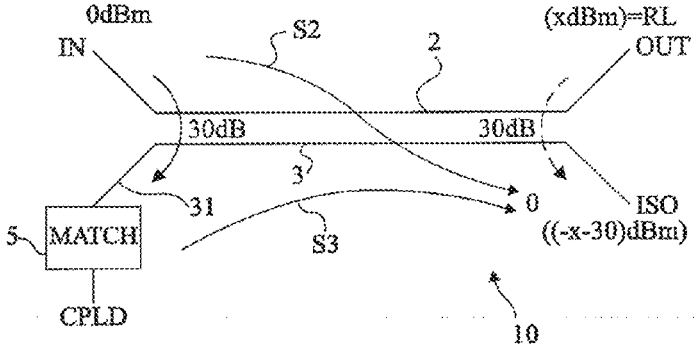

FIGS. 6A and 6B are simplified representations of real coupler part 1 and of complete coupler 10 of FIG. 5 illustrating the implementation of the method for sizing element 5.

Figure 7A:
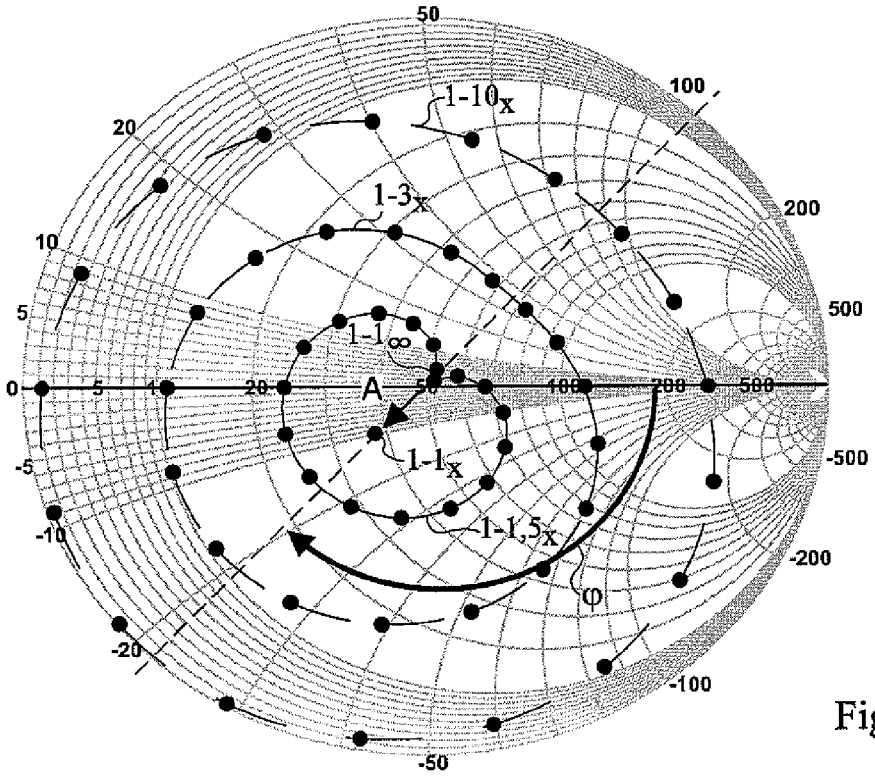
FIGS. 7A and 7B show Smith charts corresponding to FIGS. 6A and 6B.
Figure 7B:
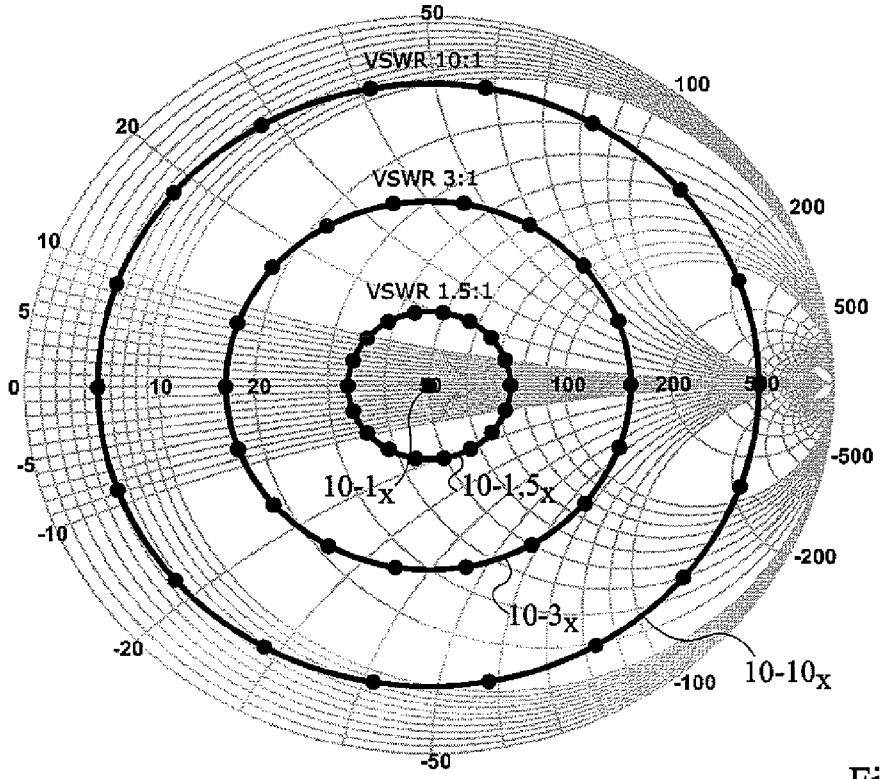

FIGS. 7A and 7B show Smith charts corresponding to FIGS. 6A and 6B.

FIG. 6A illustrates part 1, that is, coupler 10 with no matching element. On the side of terminal ISO, the return loss of port OUT (xdBm providing (−x−30) dBm after coupling) appears along with isolation signal S2. FIG. 7A shows the corresponding Smith chart. Point $1\text{-}1_X$ and mismatch circles $1\text{-}1.5_X$, $1\text{-}3_X$, and $1\text{-}10_X$ have been illustrated for a return loss representing voltage standing wave ratios of 1, 1.5, 3, and 10. Point $1\text{-}1_\infty$ reminds the ideal coupler. Amplitude A corresponds to the module between points $1\text{-}1_\infty$ and $1\text{-}1_X$. Intrinsic phase $\phi$ corresponds to the angle formed by the straight line connecting these points. Data A and $\phi$ can thus be obtained by simulation based on the characteristics of the bare coupler. Based on data A and $\phi$, and knowing operating frequency $f=2\pi/\omega$ of the coupler (for example, the central frequency of the envisaged bandwidth), the values to be given to components L and C of element 5 so that it generates a reflection coefficient such that reflected signal S3 is of amplitude A and of phase $\phi+\pi$ can be determined.

FIG. 6B shows coupler 10 obtained with element 5. Since parasitic signal S2 is canceled by the reflection S3 generated by the impedance presented on the coupled port, the sum of these signals on isolated port ISO cancels. Accordingly, there only remains useful signal (−x−30) dBm linked to the return loss (x dBm), which becomes perfectly measurable. FIG. 7B illustrates the corresponding Smith chart. It shows a point $\mathbf{10\text{-}1}_X$ and mismatch circles $\mathbf{10\text{-}1.5}_X$, $\mathbf{10\text{-}3}_X$, and $\mathbf{10\text{-}10}_X$ corresponding to those of a coupler of infinite directivity (see FIG. 3).

The determination of the inductive and capacitive elements of matching network 5, by simulation, is perfectly compatible with the forming of the couplers on isolating substrates by using printed circuit or integrated circuit technology.

The structure of the matching circuit depends on the intrinsic characteristics of the coupler, the inductive and/or capacitive circuit having a function of impedance matching to the operating frequency of the coupler. A circuit which only decouples a D.C. voltage is not considered as an impedance matching circuit.

As a specific embodiment, the inductive elements will in most cases range between 0 and 10 nH, and the capacitive elements will range between 0 and 20 pF.

It is thus possible to considerably improve the directivity of a coupler intrinsically having a low directivity. In a practical implementation, this enables decreasing the size of the actual coupler. Further, the matching in terms of effective directivity to the operating frequency is easier.

Further, it is thus possible to take into account possible parasitic signals introduced when the coupler is used in its definitive application circuit. Indeed, the performed simulations may take these different parasitic signals into account, which is a significant advantage over the usual coupler.

Figure 8:
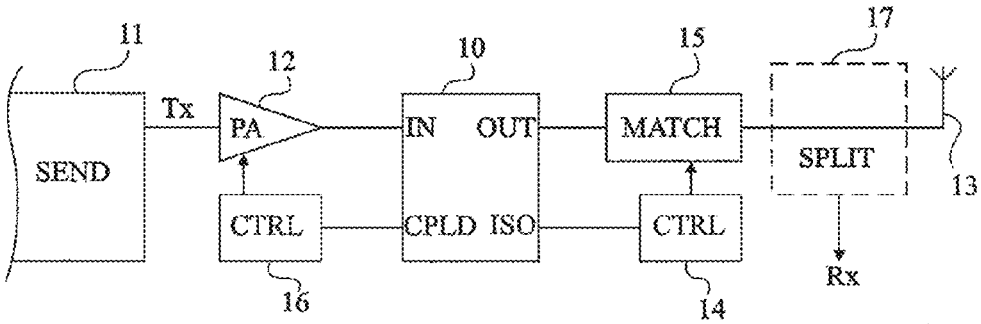
FIG. 8 is an example of architecture of a radiofrequency transmission path.

FIG. 8 is a block diagram of a radiofrequency transmission line using a coupler 10. Coupler 10 comprises a network 5 such as described hereinabove.

A transmission circuit 11 (SEND) sends a signal Tx to be transmitted to an amplifier 12 (PA) having its output intended to be connected to an antenna 13. A main line of coupler 10 is interposed between the output of amplifier 12 and antenna 13. Port IN is on the side of amplifier 12 while so-called output port OUT (sometimes also designated as DIR) is on the side of antenna 13. A coupled or secondary line of coupler 10 samples part of the power of the main line. Coupler 1 is used, in this example, at least to measure the return loss in the antenna. This measurement is used to detect a mismatching of antenna 13 to control, via a control circuit 14 (CTRL), an impedance matching circuit 15 (MATCH) interposed between the coupler (output OUT) and antenna 13. Circuit 14 exploits data that it samples from terminal ISO of coupler 10.

In the example of FIG. 1, port CPLD of the coupler, corresponding to the end of the secondary line on the side of port IN, further provides data which may also be exploited to adapt the amplifier gain by means of a circuit 16 (CTRL) receiving the data sampled from port CPLD and controlling the gain of amplifier 12. This control of the gain of amplifier 12 may replace the dynamic matching of the antenna (by network 15 or by elements integrated to the antenna).

A path splitter 17 (SPLIT) may be interposed between coupler 1 (or network 15) and antenna 13. Such a splitter is used to separate the transmission from the reception (flow Rx in FIG. 1), which is processed by a radiofrequency reception line, not shown.

Specific embodiments have been described. Various alterations and modifications will occur to those skilled in the art. In particular, the dimensions of the lines according to the frequency bands desired for the couplers can be determined by those skilled in the art by using usual methods. Further, the selection of the matching network and of the proportion of this network between the capacitive elements and the inductive elements depends on the application and on other possible technological constraints, provided to respect the above functional indications.

Such alterations, modifications, and improvements are intended to be part of this disclosure, and are intended to be within the spirit and the scope of the present invention. Accordingly, the foregoing description is by way of example only and is not intended to be limiting. The present invention is limited only as defined in the following claims and the equivalents thereto.

What is claimed is:

1. A coupler comprising:

a first conductive line intended to convey a signal to be transmitted between first and second terminals;

a second conductive line, coupled to the first one and having one end intended to provide, on a third terminal, data relative to a signal reflected on the second terminal; and an inductive and/or capacitive impedance matching circuit with no resistive element, other than a circuit exclusively used for the decoupling of a D.C. voltage, interposed between the other end of the second line and a fourth terminal of the coupler, the inductive and/or capacitive impedance matching circuit being adapted to generate a reflected signal.

2. The coupler of claim 1, wherein the components of the inductive and/or capacitive matching circuit are chosen to attenuate, at the third terminal, a signal originating from the first terminal.

3. The coupler of claim 1, wherein said matching circuit has an inductance ranging between 0 and 10 nH and a capacitance ranging between 0 and 20 pF.

4. A circuit for transmitting and/or receiving radio frequency signals, the circuit comprising:

at least one amplifier;

at least one coupler of claim 1; and at least one circuit for measuring data sampled from the third terminal.

5. A circuit comprising the coupler of claim 2, the circuit being configured to determine a first amplitude and a first phase of the reflected signal, based on a second amplitude and a second phase of the signal originating from the first terminal.

6. A coupler, comprising:

a first conductive line;

a second conductive line coupled to the first conductive line; and an inductive and/or capacitive element coupled to a terminal of the second conductive line and having an impedance configured to generate a reflected signal that reduces a parasitic signal from a terminal of the first conductive line.

7. The coupler of claim 6, wherein the impedance is configured to reduce the parasitic signal caused by a directivity of the coupler.

8. The coupler of claim 6, wherein the first conductive line comprises a first terminal and a second terminal and the second conductive line comprises a third terminal and a fourth terminal, wherein the impedance is configured to reduce a parasitic signal coupled to the fourth terminal from the first terminal.

9. The coupler of claim 8, wherein the inductive and/or capacitive element is coupled to the third terminal.

10. The coupler of claim 6, wherein the impedance is selected to cancel the parasitic signal.

11. The coupler of claim 6, wherein the inductive and/or capacitive element comprises an inductive element and a capacitive element.

12. The coupler of claim 11, wherein the inductive element is in series with the capacitive element.

13. The coupler of claim 6, wherein the inductive and/or capacitive element has an inductance between 0 and 10 nH and a capacitance between 0 and 20 pF.

14. A circuit for transmitting and/or receiving radio frequency signals, comprising:

at least one amplifier;

at least one coupler of claim 6; and at least one circuit for detecting a signal from the second conductive line.

15. A coupler, comprising:

a first conductive line;

a second conductive line coupled to the first conductive line; and a matching network coupled to the second conductive line, the matching network comprising an inductor and a capacitive element, the inductor being coupled in series with the capacitive element.

16. The coupler of claim 15, wherein the inductor has an inductance between 0 and 10 nH.

17. The coupler of claim 15, wherein the capacitive element has a capacitance between 0 and 20 pF.

18. The coupler of claim 15, wherein the matching network has an impedance configured to reduce a parasitic signal at a terminal of the second conductive line.

19. A coupler, comprising:

a first conductive line;

a second conductive line coupled to the first conductive line; and means for generating a reflected signal that reduces a parasitic signal from a terminal of the first conductive line.

20. The coupler of claim 19, wherein the means for generating a reflected signal further determines a first amplitude and a first phase of the reflected signal, based on a second amplitude and a second phase of the parasitic signal from the terminal of the first conductive line.

21. A coupler, comprising:

a first conductive line, comprising a first terminal and a second terminal, configured to convey a signal to be transmitted between the first and second terminals;

a second conductive line coupled to the first conductive line; and a matching network coupled to the second conductive line, the matching network comprising an inductive element and a capacitive element, the inductive element being coupled in series with the capacitive element.

22. The coupler of claim 21, wherein the inductive element has an inductance between 0 and 10 nH.

23. The coupler of claim 21, wherein the capacitive element has a capacitance between 0 and 20 pF.

24. The coupler of claim 21, wherein the matching network has an impedance configured to reduce a parasitic signal at a terminal of the second conductive line.

* * * * *

UNITED STATES PATENT AND TRADEMARK OFFICE

CERTIFICATE OF CORRECTION

PATENT NO. : 8,410,864 B2
APPLICATION NO. : 12/494046
DATED : April 2, 2013
INVENTOR(S) : Sylvain Charley et al.

It is certified that error appears in the above-identified patent and that said Letters Patent is hereby corrected as shown below:

In the Specifications

Col. 2, line 38, should read:
circuit brings an inductance ranging between 0 and 10 nH Signed and Sealed this
Fourteenth Day of May, 2013

Teresa Stanek Rea
*Acting Director of the United States Patent and Trademark Office*